United States Patent [19]

Bergamini et al.

[11] Patent Number: 5,038,838

[45] Date of Patent: Aug. 13, 1991

[54] SYSTEM FOR SAFE VAPOUR RECOVERY, PARTICULARLY SUITABLE FOR FUEL FILLING INSTALLATIONS

[75] Inventors: Giorgio Bergamini; Ernesto Paris, both of Bari, Italy

[73] Assignee: Nuovopignone-Industrie Meccaniche E Fonderia S.p.A., Florence, Italy

[21] Appl. No.: 460,745

[22] Filed: Jan. 4, 1990

[30] Foreign Application Priority Data

Jan. 4, 1989 [IT] Italy ..... 19016 A/89

[51] Int. Cl.[5] ..... B65B 3/18

[52] U.S. Cl. ..... 141/59; 141/290; 141/82; 137/587; 220/85 VS; 220/85 VR

[58] Field of Search ..... 141/59, 44–46, 141/47, 83, 82, 94, 51, 290; 220/85 VS, 85 VR; 137/587–589

[56] References Cited

U.S. PATENT DOCUMENTS

| | | | |
|---|---|---|---|
| 3,826,291 | 7/1974 | Steffans | 141/59 |
| 4,058,147 | 11/1977 | Stary et al. | 141/45 |
| 4,082,122 | 4/1978 | McGahey | 141/59 X |
| 4,197,883 | 4/1980 | Mayer | 141/59 |
| 4,202,385 | 5/1980 | Voelz et al. | 141/59 |
| 4,253,503 | 3/1981 | Gunn | 141/59 |
| 4,260,000 | 4/1981 | McGahey et al. | 141/59 |
| 4,306,594 | 12/1981 | Planck | 141/59 |

*Primary Examiner*—Ernest G. Cusick
*Attorney, Agent, or Firm*—Morgan & Finnegan

[57] ABSTRACT

A system for safe vapor recovery, particularly for fuel filling installations, in which a positive displacement pump effects controlled drawing of a vapor-air mixture into a vapor return pipe which extends to the bottom of the underground tank of the installation. The system is provided with a non-return valve downstream of the pump and a special circuit for effecting the controlled in-drawing based on the quantity of fuel delivered, the difference in temperature between the underground tank and the recovered mixture, and especially on the density of the mixture, by which its degree of explosiveness is determined. Structure are also provided for preventing or limiting explosion propagation.

4 Claims, 2 Drawing Sheets

1
2
3
4
5
6
7
8
9
10
11
12
13
14
15
16
17
18
19
20
21
22
23
24
25
26
27
28
29
30
31
32
33
34
35
36
37
38
M
Qc
Tc
Δp
Tm
Po

SYSTEM FOR SAFE VAPOUR RECOVERY, PARTICULARLY SUITABLE FOR FUEL FILLING INSTALLATIONS

This invention relates to a new vapor recovery system, particularly suitable for fuel filling installations, which not only ensures effective, safe and complete recovery without the need for bellows-type seal elements, but which while acknowledging explosion danger conditions allows maximum intrinsic safety relative to the formation of explosive mixtures under any operating condition. The system is also able to operate under critical conditions, being provided with adequate devices for preventing explosion propagation.

BACKGROUND OF THE INVENTION

Vapor recovery systems in fuel filling installations are already known in the state of the art. These systems comprise a bellows element the purpose of which is to form a seal between the delivery gun and the fuel filler pipe of the motor vehicle tank to be filled, together with a further tube which leads from the dome of the underground tank of the fuel filling installation to said motor vehicle tank to recover the vapor from the tank with or without the aid of a suction pump.

Such known systems have however a series of drawbacks, the most important of which is the critical nature of the necessary hermetic seal to be provided by said bellows, which requires precise and relatively laborious fitting and continuous maintenance.

In this respect, if the bellows does not form a perfect seal, not only is there a considerable fall-off in the efficiency of the system as not all the vapor is drawn in, but precarious safety conditions also arise, especially if a vapor suction pump is used. The now possible uncontrolled in-drawing of air could dilute the vapor-air mixture too much, which as is well known, would make it a critical explosion zone. To overcome this difficulty, known delivery guns have been provided with a device for shutting off delivery if the seal is not perfect (no seal, no flow). Such devices have not encountered favor with the user, in particular in self-service stations, who tends to break their connection by damaging them, with resultant system inefficiency and danger.

A further drawback of known systems is the difficulty of providing the underground tank of the installation, which is at a lower temperature than the vehicle fuel tank, with the specific air quantity necessary to compensate the reduction in volume of the recovered vapor determined by the lower local temperature. This could result in vacuum in the dome of the underground tank, and which, although being a normal and not dangerous condition in installations without vapor recovery, becomes very dangerous in known installations incorporating recovery in which the recovery circuit directly feeds the dome of the underground tank, because of the possible repeated and uncontrolled absorption of air due to seal defects, leading to the aforesaid consequences.

A further drawback is the fact that in known recovery systems using suction pumps or injectors, any suction excess not only produces the aforesaid explosion dangers but can also generate a pressure in the underground tanks which is deleterious from the environmental protection aspect due to possible leakages from the tanks.

The object of the present invention is to obviate said drawbacks by providing a system for the safe recovery of vapor, particularly suitable for fuel filling installations, which does not use any bellows-type seal element and which ensures effective and complete vapor recovery without any danger of explosion or undersirable pressurization of the underground tank.

SUMMARY OF THE INVENTION

The present vapor recovery system comprises a return pipe for the recovered vapor air mixture, no longer feeds the mixture into the dome of the underground tank of the installation, but instead into the bottom of the tank, from which the mixture bubbles through the fuel and into the dome. Controlled suction of the vapor-air mixture is provided by a positive displacement pump. The speed of the pump is continuously controlled on the basis of the delivered volumetric throughput, so as to draw in a volumetric quantity of vapor-air mixture equal to the volumetric quantity of fuel delivered plus a possible excess of air depending on the temperature of the two tanks, while continuously comparing the density of the in-drawn mixture with at least one limiting value indicative of a very dilute and thus explosive mixture. In this manner, by bubbling the recovered vapor-air mixture through the fuel, the mixture temperature is rapidly adjusted to the temperature of the underground tank, resulting in its rapid volumetric adjustment, so allowing a greater volumetric quantity to be drawn in than the quantity delivered, as is required particularly in the case of underground tanks at a lower temperature than the recovered mixture. Again, prolonging the return pipe to the bottom of the underground tank means that the pressure in this pipe is always positive, thus preventing any possibility of undesirable infiltration of air from the outside and any pressurizing of the tank dome.

The use of a positive displacement suction pump makes it simple to draw in said required specific volumetric quantity of mixture. In this respect, it can be shown analytically that said volumetric quantity Qm can be expressed by the following relationship:

$$Qm = Qc\left[1 + \frac{Po - Pv(Tc)}{Po}\cdot\frac{Tm}{Tc} - \frac{Po - Pv(Tm)}{Po}\right]\cdot\left[1 - \frac{\rho 1 - \rho}{\rho 1 - \rho 2}\right]\cdot\frac{Po}{Po - \Delta p} \quad (I)$$

where:

Qc represents the volumetric throughput of the delivered fuel;

Po represents the measured atmospheric pressure;

Δp represents the pressure drop of the vapor-air mixture measured at the inlet of the positive displacement pump;

Tc represents the measured temperature of the fuel to be delivered, corresponding in practice to the temperature of the vapor-air mixture contained in the dome of the underground tank of the filling installation;

Tm represents the measured temperature of the vapor-air mixture drawn in by the delivery gun;

Pv(Tc) represents the characteristic vapor pressure of the fuel at temperature Tc;

Pv(Tm) represents the characteristic vapor pressure of the fuel at temperature Tm;

$\rho$ represents the density of the vapor-air mixture;

$\rho 1$ and $\rho 2$ represent temperature-based limiting values defining the density range within which the volumetric throughput Qm has to be gradually reduced to zero to avoid any danger of an explosion for a mixture too diluted with air.

In said formula, the first term in brackets is indicative of the excess air quantity to be drawn in to compensate the reduction in volume consequent on the underground tank temperature being lower than the temperature of the mixture to be recovered. This is valid only for $Tm \geqq Tc$, whereas for $Tm < Tc$ this is put equal to 1. The second term in brackets indicates whether the mixture is dangerous because of being too dilute, so that the volumetric throughput Qm must be reduced. It is valid only for $\rho 2 \leqq \rho \leqq \rho 1$, whereas for $\rho > \rho 1$ it is put equal to 1 and for $\rho < \rho 2$ it is put equal to 0.

Said term therefore enables the system to be protected even in the case of incorrect handling during delivery, such as extracting the delivery gun from the vehicle fuel filler pipe during delivery, or if imperfections or special devices are present in the structure of the vehicle tank. From the aforesaid it is therefore also apparent that the fuel delivery can be easily shut off in all abnormal cases involving excess dilution of the mixture.

Finally, the last term takes account of the pressure drop of the mixture drawn into the return pipe from the delivery gun at the positive displacement pump inlet, which is used to obtain the mixture density.

In this respect, said density p is calculated with an empirical formula of the type:

$$\rho = K(T)\frac{\Delta p^a}{v^b} \tag{2}$$

where v indicates the velocity of the mixture within the return pipe, which is substantially proportional to the rotational speed n of the positive displacement pump, K(T) is a variable which is a function of the temperature and type of fuel used, $\Delta p$ is said pressure drop, and the exponents a and b are experimentally obtained values which depend on the geometry and roughness of the return pipe from the draw-in point to the suction pump, which pipe must be such as to in all cases ensure that the motion of the drawn-in mixture is turbulent, this being an essential condition for the validity of formula (2).

For this purpose, according to one characteristic of the present invention, said pipe is provided internally either with an inserted spiral element or with granular additions glued to the inner wall, or is internally machined or chemically attacked to roughen said wall to create considerable wall roughness and thus ensure highly turbulent motion.

According to a preferred embodiment of the present invention, said wall roughness is formed and concentrated in the rigid metal portion of the return pipe at the delivery gun, and which is given a substantially smaller cross-section than the rest of the pipe, which is in the form of a rubber hose and therefore of non-constant geometry.

In this manner said pressure drop $\Delta p$ in the return pipe from the delivery gun to the inlet of the positive displacement pump is substantially concentrated in said portion which, being of stable and fixed mechanical geometry, allows an effective and repeatable measurement of said pressure drop, this measurement ensuring the safety of the system by allowing correct, exact and repeatable evaluation of said density $\rho$ of the in-drawn vapor-air mixture. So that the system operates safely, the apparatus can be set with K(T) values obtained experimentally once and for all, by using either a summer fuel, i.e., one which gives a calculated $\rho$ value which is always less than or equal to the real value and thus causes the protection against excessive mixture dilution to intervene before the effective danger state exists, or a winter fuel which gives lower K(T) values, however in this case increasing the $\rho 1(T)$ and $\rho 2(T)$ values by a suitable margin, particularly for temperatures exceeding 0° C.

This second procedure allows operation with greater precision at low temperatures and with winter gasoline when the margins in the variation of the density $\rho$ about the limits of possible explosion are modest, and where the first procedure would rapidly lead to shutoff of the suction.

It is apparent that, if the positive displacement pump drive motor is rotated at a rotational speed n given by $$n = \frac{Qm}{C} \tag{3}$$

where C is the pump piston displacement, then the pump will always draw in the optimum required volumetric quantity.

Thus, the system for safe vapor recovery, particularly for fuel filling installations comprising a pipe for returning the vapor-air mixture from the delivery gun to the underground tank of the installation, a pump driven by an electric motor for drawing in said mixture, a vent pipe connecting the bottom of the underground tank to atmosphere, a pipe for conveying excess vapor from the dome of the underground tank to a vapor condensation unit and a return pipe from said unit to said dome for the condensed vapor, is characterised according to the present invention in that said return pipe for the vapor-air mixture is provided with a nonreturn valve downstream of the pump, and is connected to said vent pipe which extends to the bottom of said underground tank of the installation and is provided with a check valve towards atmosphere, the suction pump which acts on said return pipe being a positive displacement pump, the electric motor of which is controlled by means which regulate its rotational speed moment by moment as a function of the volumetric throughput of the delivered fuel, taking account of pressure drop, with a possible excess of air depending on the temperatures of the underground tank and of the vapor-air mixture, and continuously measuring the effective density of said mixture and comparing it with a limiting value indicative of a mixture which is very diluted with air and therefore explosive, means being also provided for preventing and/or limiting the propagation of the explosion and for ensuring that the vapor-air mixture in said return pipe is turbulent upstream of said positive displacement pump.

According to a further characteristic of the present invention, said means for preventing and/or limiting the propagation of the explosion consist of two flame traps inserted one in the vapor return pipe of the delivery gun and one downstream of said positive displacement pump, and of prolonging said return pipe from the vapor condensation unit as fas as the bottom of said underground tank of the installation, and also providing it with a suction pump.

In this manner, any explosion across the pump cannot propagate either downstream of the pump where the pipes are under positive pressure, or into the vehicle tank being filled, the fact of bubbling the vapor recovered from the condensation unit into the fuel in the underground tank at the temperature of this latter, and thus without cooling the vapor, preserves said recovery operation from any danger of explosion.

A further characteristic of the present invention is that said means for regulating moment by moment the rotational speed of the electric motor of the positive displacement suction pump for the vapor-air mixture consist of a memory register in which the values of the vapor pressure as a function of the temperature Pv(T) for the fuel used are stored, to the inputs of which there are fed the measured values of the delivered fuel temperature Tc and the temperature of the vapor-air mixture Tm, and the outputs of which are connected to an operational unit to which the measured values of the atmospheric pressure Po and of said temperatures Tc and Tm are fed; the output of said operational unit, which processes the input data in accordance with the expression $$\left[1 + \frac{Po - \mathrm{Pv}(Tc)}{Po} \cdot \frac{Tm}{Tc} - \frac{Po - \mathrm{Pv}(Tm)}{Po}\right]$$

then being fed to a comparator which compares it with 1, and if it is less than 1 puts it equal to 1 whereas in other cases it leaves it unchanged, the output of said comparator being fed to a multiplication unit to which there is also fed the measured volumetric quantity of fuel Qc delivered and the output of another operational unit which calculates the term $$\frac{Po}{Po - \Delta p},$$

this unit being fed at its input with the measured atmospheric pressure Po and the pressure drop Δp of the vapor-air mixture measured at the inlet of the positive displacement pump; a further memory register, in which the temperature-based limiting density values $\rho 1$ and $\rho 2$ are stored, being fed with the measured temperature Tm and its outputs being connected to a third operational unit to which the output of a second multiplication unit is connected, to the inputs of this latter there being fed the output of a memory register in which the experimental values of K as a function of temperature are stored and the input of which is fed with said Tm, and the output of a further operational unit the inputs of which are fed with said pressure drop Δp and with the feedback output of the electric motor, which provides the effective rotational speed of the motor, said operational unit processing the input data in accordance with the expression $\Delta p^a/V^b$, the output of said third operational unit which determines the term $$\left[1 - \frac{\rho 1 - \rho}{\rho 1 - \rho 2}\right]$$

being then fed to a comparator in which it is unaltered if lying between 0 and 1, is put equal to 1 if greater than 1, and is put equal to 0 if less than 0 with the comparator also providing an output signal for shutting off fuel delivery; the output of this latter comparator being fed to said multiplication unit the output of which is connected to a divideer for dividing by the known cylinder displacement of the positive displacement pump used, so that the output represents the optimum pump rotational speed which is finally fed, together with said feedback output of the electric motor, to the input of a PID controller the output of which is fed to said electric motor via a torque-current converter.

This therefore ensures that the output of said multiplication unit provides the expression (1) in which the density $\rho$ is determined accurately by the expression (2), so that in the PID controller the real rotational speed of the motor is compared with the optimum value given by the expression (3). It also ensures that fuel delivery is shut off every time the vapor-air mixture is too dilute.

According to a further characteristic of the present invention said means for ensuring turbulent motion of the vapor-air mixture in said return pipe upstream of said positive displacement pump consist of a spiral element inserted into said return pipe upstream of said positive displacement pump, or a granular material glued to the inner wall of said pipe, or of roughening of said wall obtained by mechanical machining or chemical attack.

Finally, according to a preferred embodiment of the present invention said means for ensuring turbulent motion of the vapor-air mixture in said return pipe upstream of said positive displacement pump are applied to that portion of said return pipe lying within the delivery gun itself, said portion having a cross-section substantially smaller than the rest of the return pipe.

The invention is described in detail hereinafter with reference to the accompanying drawings which illustrate a preferred embodiment thereof given by way of non-limiting example only, in that technical and constructional modifications can be made thereto but without leaving the scope of the present invention.

DETAILED DESCRIPTION OF THE PREFERRED EMBODIMENT

Figure 1:
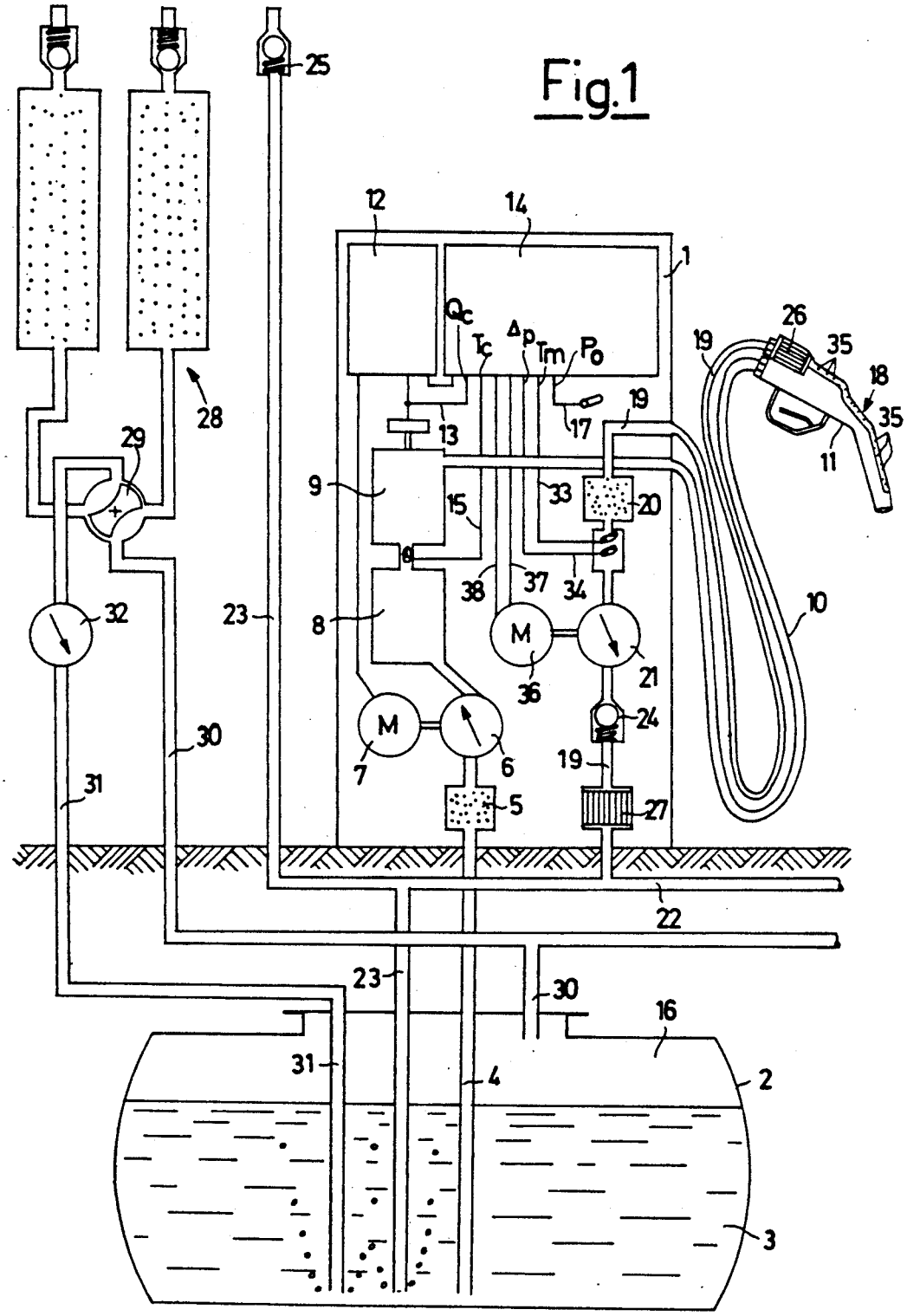
FIG. 1 is a sectional schematic view of a fuel filling installation using the vapor recovery system according to the invention.

With reference to the figures, 1 indicates the pumping column of a fuel filling installation and 2 the underground tank of said installation, the fuel 3 of which, drawn in through the feed pipe 4 and the filter cartridge 5 by the feed pump 6 driven by the electric motor 7, is conveyed through the degasser 8, the volumetric throughput meter 9 and from here to the delivery pipe 10 provided with a delivery gun 11.

Said meter 9, which measures the volumetric quantity Qc of fuel delivered, is connected to the counter 12 and, via the line 13, to the logic unit 14 to which there are fed, via the line 15, the measured temperature Tc of the fuel to be delivered, which is considered substantially equal to that of the vapor-air mixture contained in the dome 16 of said underground tank 2, and, via the line 17, the measured atmospheric pressure Po.

The delivery gun 11 is provided with a second rigid channel 18 for in-drawing the vapor-air mixture from the fuel filler pipe, not shown in the figure, of the vehicle tank to be filled, said channel being connected to the return pipe 19 which conveys said mixture, through a filter cartridge 20, to the bottom of the underground tank 2, from which it bubbles into the dome 16. Said forced conveying is obtained by a positive displacement pump 21 and by connecting the manifold 22 with which the return pipes of all the pumping columns of the installation communicate, to the installation vent pipe 23, which in known manner connects the bottom of the underground tank 2 to atmosphere.

As said manifold 22 is always under pressure, to prevent any leakage of vapor-air mixture into the atmosphere through the gun or through the vent pipe, a non-return valve 24 is provided downstream of the positive displacement pump 21 and a further check valve 25 is provided at the free end of said vent pipe 23. Again, in order to prevent explosion propagation, two flame traps 26 and 27 are provided at the end of said channel 18 of the delivery gun 11, which is connected to said return pipe 19, and downstream of said positive displacement pump 21.

In addition, to prevent and/or limit damage by a possible explosion in the vapor condensation unit 28, which is of usual type connected by a four-way two-position valve 29 and the pipe 30 to the dome 16 of said underground tank 2, the return pipe 31 from said unit is provided with a suction pump 32 and is prolonged to the bottom of said underground tank 2 so that the recovered vapor is compelled, without being previously cooled, to reach the dome 16 by bubbling, and thus undergoing cooling, through the fuel 3 in the underground tank 2.

The temperature Tm of the in-drawn vapor-air mixture is measured upstream of the positive displacement pump 21, this measurement being fed to the logic unit 14 via the line 33, and the pressure drop $\Delta p$ of the mixture in the return pipe between the delivery gun and the positive displacement pump is measured and fed to said logic unit 14 via the line 34.

In addition, as the accuracy of the $\Delta p$ measurement depends on the accuracy with which the effective value of the density $\rho$ of the in-drawn mixture is calculated, and on which the safety of the installation depends, the inner wall of said rigid channel 18 provided in the delivery gun 11 for drawing-in the vapor-air mixture is roughened artificially, for example by attaching granular material 35 by gluing, so that besides ensuring turbulent motion of said mixture, as is necessary for the validity of formula (2), a fixed artificially high pressure drop is created which makes any other pressure drops which arise along the return pipe 19 between the gun 11 and pump 21 from accidental causes practically negligible. This artificial pressure drop is therefore that to be determined as the value $\Delta p$.

Figure 2:
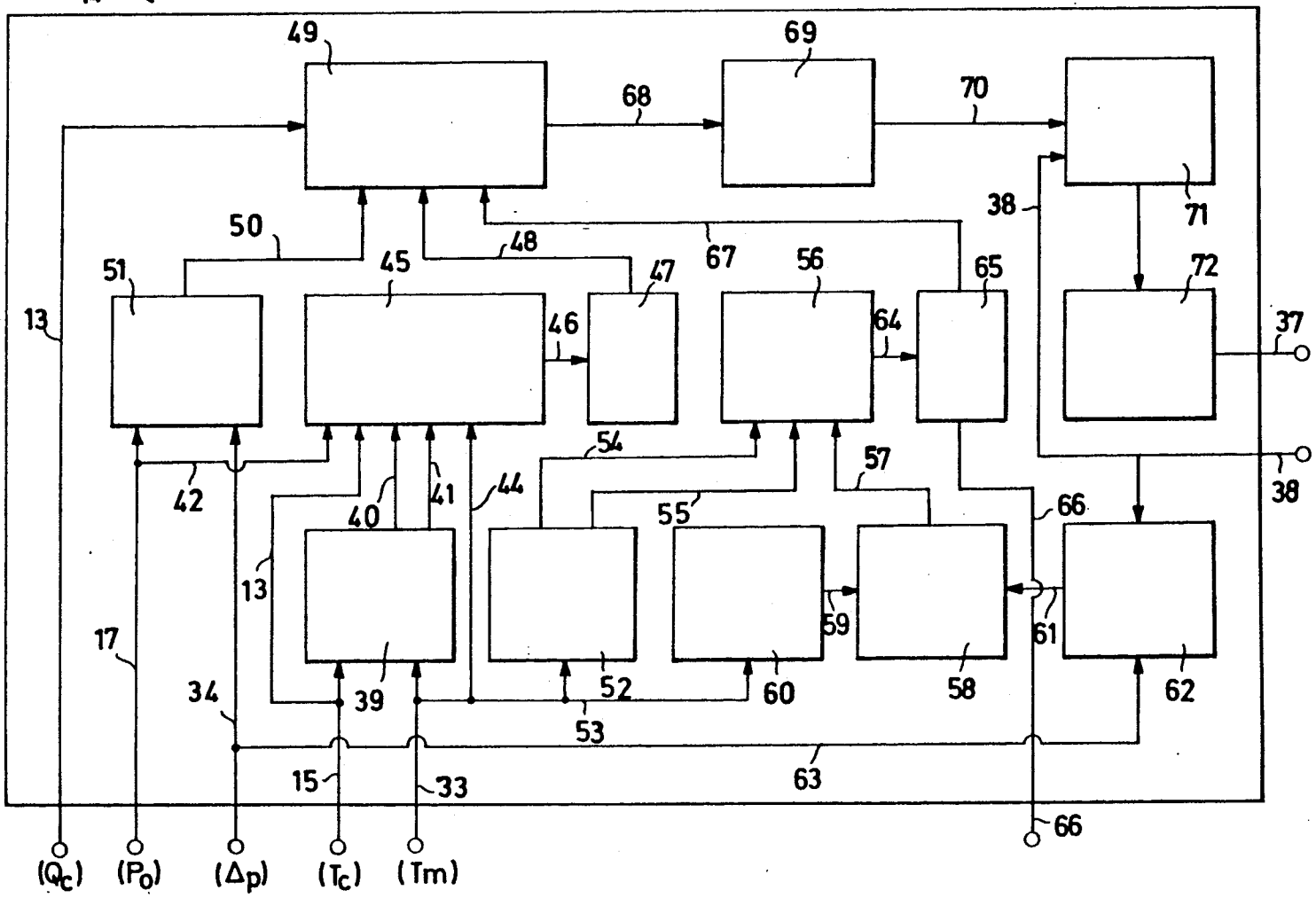
FIG. 2 is a block diagram of the circuit for controlling moment by moment the rotational speed of the positive displacement pump of the recovery system according to the invention.

Finally, said positive displacement pump 21 is driven by an electric motor 36 connected via the lines 37 and 38 to said logic unit 14 and driven under the moment-by-moment control of this latter at a rotational speed n expressed by said expression (3). For this purpose, said logic unit 14 comprises (see FIG. 2) a memory register 39 which, fed at its input with the measured values of the temperatures Tc and Tm via said lines 15 and 33, provides at its outputs 40 and 41 the vapor pressure values Pv(Tc) and Pv(Tm) at said two temperatures respectively. The two outputs 40 and 41 are then fed, together with the measured atmospheric pressure value Po derived from the pipe 17 via the line 42 and said values of Tc and Tm derived from the pipes 15 and 33 via the lines 43 and 44 respectively, to the input of an operational unit 45 which calculates the expression $$\left[1 + \frac{Po - Pv(Tc)}{Po} \cdot \frac{Tm}{Tc} - \frac{Po - Pv(Tm)}{Po}\right]$$

The output 46 of said operational unit 45 is then fed to a comparator 47 which compares it with 1, and if it is less than 1 it puts it equal to 1, otherwise it leaves it unaltered. The output 48 of said comparator 47 is fed to a multiplication unit 49 together with the measured value of the volumetric quantity Qc of fuel delivered, via the line 13, and with the output 50 of a further operational unit 51 which calculates the term $$\frac{Po}{Po - \Delta P},$$

and is fed at its inputs by the lines 17 and 34 which provide the measured values of Po and of the pressure drop $\Delta p$ respectively. A further memory register 52, fed with the value Tm derived from the line 33 via the line 53, provides at its outputs 54 and 55 the limiting density values $\rho 1$ and $\rho 2$ which are fed to a third operational unit 56 to which there is also fed the output 57 of a second multiplication unit 58 which substantially determines the value of the effective density $\rho$ in accordance with said expression (2). In this respect, said multiplication unit 58 is fed respectively with the output 59 of a memory register 60 which, fed with the value Tm via said line 53, provides the value K(T), and the output 61 of a further operational unit 62 which calculates the expression $\Delta p^a/V^b$ or, the same thing, the expression $\Delta p^a/n^b$, by being fed with the value $\Delta p$ derived from the line 34 via the line 63, and with the feedback line 38 of the electric motor 36 (see FIG. 1) which provides the rotational speed n of the motor.

The output 64 of said third operational unit 56, which is substantially the value of the expression $$\left[1 - \frac{\rho 1 - \rho}{\rho 1 - \rho 2}\right],$$

is fed to a comparator 65 which keeps it unaltered if between 0 and 1, puts it equal to 1 if greater than 1, and puts it equal to 0 if less than 0 and simultaneously provides a signal for shutting off fuel delivery via the line 66. The output 67 of said comparator 65 is then also fed to said multiplication unit 49, the output 68 of which, providing substantially the value of the volumetric quantity Qm expressed by (1), is divided by the known cylinder displacement C of the positive displacement pump 21 in the divider 69, which thus provides at its output 70 the optimum rotational speed n for said positive displacement pump. Finally, said output 70 is fed, together with said feedback line 38 from the electric motor 36, to a PID controller 71, the output of which is fed via a torque-current converter 72 to power said electric motor 36 via said line 37.

We claim:

1. A system for safe vapor recovery, comprising a pipe for returning a vapor air mixture from a delivery gun to an underground tank of an installation, a pump driven by an electric motor for drawing in said mixture, a vent pipe connecting a bottom of an underground tank to atmosphere, a pipe for conveying excess vapor from a dome of the underground tank to a vapor condensation unit and a return pipe from said unit to said dome for condensed vapor, said return pipe for the vapor-air mixture is provided with a non-return valve downstream of the pump and is connected to said vent pipe, said vent pipe extending to the bottom of said underground tank of the installation and is provided with a check valve towards atmosphere, a positive displacement pump which acts on said return pipe, an electric motor of said pump is controlled by means which regulate its rotational speed moment by moment as a function of volumetric throughput of delivered fuel, taking account of pressure drop of the mixture in the return pipe between the delivery gun and the positive displacement pump, said pump drawing in a volumetric quantity of vapor air mixture equal to the volumetric throughput of delivered fuel with a possible excess of air depending on the temperatures of the underground tank and of the vapor-air mixture, and continuously measuring the density of said mixture and comparing it with at least one limiting vapor-air density value said limiting density value being indicative of a vapor-air mixture which is very diluted with air and therefore explosive, means being also provided for preventing and/or limiting the propagation of an explosion of the vapor-air mixture and means for ensuring that the vapor-air mixture in said return pipe is turbulent upstream of said positive displacement pump.

2. A system for the safe recovery of vapor as claimed in claim 1, wherein said means for preventing and/or limiting the propagation of an explosion consist of two flame traps inserted one in the vapor return pipe of the delivery gun and one downstream of said positive displacement pump, and of extending said return pipe from the vapor condensation unit as far as the bottom of said underground tank of the installation, and also providing said return pipe with a suction pump.

3. A system for the recovery of vapor as claimed in claim 1, wherein said means for regulating moment by moment the rotational speed of the electric motor of the positive displacement suction pump for the vapor-air mixture consist of a memory register in which values of vapor pressure as a function of the temperature Pv(T) for the fuel used are stored, to inputs of which there are fed measured values of delivered fuel temperature Tc and vapor-air mixture temperature Tm respectively, and outputs of which are connected to an operational unit to which measured values of atmospheric pressure Po and of said temperatures Tc and Tm are fed; the output of said operational unit, which processes the input data in accordance with an expression $$\left[1 + \frac{Po - \mathrm{Pv}(Tc)}{Po} \cdot \frac{Tm}{Tc} - \frac{Po - \mathrm{Pv}(Tm}{Po}\right]$$

then being fed to a comparator which compares each value of processed input data with 1, and if a value is less than 1 puts it equal to 1 whereas in other cases the value is left unchanged, the output of said comparator being fed to a multiplication unit to which there are also fed measured volumetric quantity of fuel Qc delivered and output of another operational unit which calculates a term $$\frac{Po}{Po - \Delta p},$$

this operational unit being fed at its input with measured values of atmospheric pressure Po and of pressure drop Δp of the vapor-air mixture measured at an inlet of the positive displacement pump; a further memory register, in which temperature-based limiting density values p1 and p2 are stored, being fed with the measured temperature Tm and outputs of said further memory register being connected to a third operational unit to which an output of a second multiplication unit is connected, to inputs of this latter there being fed output of a memory register in which experimental values of K as a function of temperature are stored and input of which is fed with said Tm, and output of a further operational unit inputs of which are fed with said pressure drop Δp and with feedback output of the electric motor, said operational unit processing input data in accordance with an expression $\Delta p^a/v^b$, output of said third operational unit which determines a term $$\left[1 - \frac{\rho 1 - \rho}{\rho 1 - \rho 2}\right]$$

being then fed to a comparator by which said term is left unaltered if lying between 0 and 1, is put equal to 1 if greater than 1, and is put equal to 0 if less than 0 with the comparator providing a simultaneous output signal for shutting off fuel delivery; the output of this latter comparator being fed to said multiplication unit, the output of which is connected to a divider for dividing by known cylinder displacement C of the positive displacement pump used, so that its output represents the optimum pump rotational speed which is finally fed, together with said feedback output of the electric motor, to the input of a PID controller, output of which powers said electric motor via a torque-current converter.

4. A system for the safe recovery of vapor as claimed in claims 1, 2 or 3, wherein said means for ensuring turbulent motion of the vapor-air mixture in said return pipe upstream of said positive displacement pump consist of a spiral element inserted into said return pipe upstream of said pump.

* * * * *